US007854497B2

(12) United States Patent
Cruz-Uribe et al.

(10) Patent No.: US 7,854,497 B2
(45) Date of Patent: Dec. 21, 2010

(54) FLUID EJECTION DEVICE

(75) Inventors: Tony S Cruz-Uribe, Corvallis, OR (US); Adel Jilani, Corvallis, OR (US); David Pidwerbecki, Corvallis, OR (US); Jun Zeng, Corvallis, OR (US); Hui Liu, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 590 days.

(21) Appl. No.: 11/929,161

(22) Filed: Oct. 30, 2007

(65) Prior Publication Data

US 2009/0109262 A1 Apr. 30, 2009

(51) Int. Cl.
*B41J 2/045* (2006.01)
*B41J 2/14* (2006.01)
*B41J 2/16* (2006.01)

(52) U.S. Cl. ..... 347/71; 347/20; 347/44; 347/47; 347/48; 347/54; 347/68; 347/69

(58) Field of Classification Search ..... 347/68, 347/69, 71
See application file for complete search history.

(56) References Cited

U.S. PATENT DOCUMENTS

| | | | | |
|---|---|---|---|---|
| 5,959,643 | A | 9/1999 | Temple et al. | |
| 5,965,970 | A * | 10/1999 | Takeuchi et al. | 310/324 |
| 5,988,786 | A | 11/1999 | Waller et al. | |
| 6,257,706 | B1 * | 7/2001 | Ahn | 347/54 |
| 6,331,052 | B1 | 12/2001 | Murai et al. | |
| 6,336,717 | B1 * | 1/2002 | Shimada et al. | 347/71 |
| 6,467,886 | B1 * | 10/2002 | Takao et al. | 347/68 |
| 6,497,476 | B1 | 12/2002 | Namba et al. | |
| 6,536,873 | B1 | 3/2003 | Lee et al. | |
| 6,584,660 | B1 | 7/2003 | Shimogawa et al. | |
| 6,676,248 | B1 | 1/2004 | Hollands | |
| 6,682,178 | B2 | 1/2004 | Yazaki | |
| 6,712,455 | B2 | 3/2004 | Dante | |
| 6,712,456 | B2 * | 3/2004 | Matsuzawa et al. | 347/70 |
| 7,121,650 | B2 * | 10/2006 | Chung et al. | 347/68 |
| 7,229,160 | B2 * | 6/2007 | Kobayashi | 347/68 |
| 2004/0263582 | A1 * | 12/2004 | Sugahara | 347/68 |
| 2005/0157096 | A1 | 7/2005 | Truninger et al. | |
| 2007/0120896 | A1 | 5/2007 | Stephens et al. | |

FOREIGN PATENT DOCUMENTS

JP 06182998 7/1994

OTHER PUBLICATIONS

International Search Report for Application No. PCT/US2008/080879. Report issued May 29, 2009.

* cited by examiner

*Primary Examiner*—Ryan Lepisto

(57) ABSTRACT

A fluid ejection device includes a fluid chamber having a first sidewall and a second sidewall, a flexible membrane extended over the fluid chamber and supported at an end of the first sidewall and an end of the second sidewall, an actuator provided on the flexible membrane, a first gap provided between the flexible membrane and the end of the first sidewall, and a second gap provided between the flexible membrane and the end of the second sidewall, and compliant material provided within the first gap and within the second gap. As such, the actuator is adapted to deflect the flexible membrane relative to the fluid chamber.

23 Claims, 4 Drawing Sheets

FLUID EJECTION DEVICE

BACKGROUND

An inkjet printing system, as one embodiment of a fluid ejection system, may include a printhead, an ink supply which supplies liquid ink to the printhead, and an electronic controller which controls the printhead. The printhead, as one embodiment of a fluid ejection device, ejects drops of ink through a plurality of nozzles or orifices and toward a print medium, such as a sheet of paper, so as to print onto the print medium. Typically, the orifices are arranged in one or more columns or arrays such that properly sequenced ejection of ink from the orifices causes characters or other images to be printed upon the print medium as the printhead and the print medium are moved relative to each other.

One type of printhead includes a piezoelectrically actuated printhead. The piezoelectrically actuated printhead includes a substrate defining a fluid chamber, a flexible membrane supported by the substrate over the fluid chamber, and an actuator provided on the flexible membrane. In one arrangement, the actuator includes a piezoelectric material which deforms when an electrical voltage is applied. As such, when the piezoelectric material deforms, the flexible membrane deflects thereby causing ejection of fluid from the fluid chamber and through an orifice or nozzle communicated with the fluid chamber.

One way to increase orifice or nozzle density or pitch is by reducing a width or distance between sidewalls of the fluid chamber. Reducing the width or distance between sidewalls of the fluid chamber, however, narrows the support for the flexible membrane thereby demanding an increased drive voltage for the actuator due to the greater stiffness of the flexible membrane. Thus, to operate the actuator with the same drive voltage, the flexible membrane is often made thinner. Making the flexible membrane thinner, however, increases strain on the flexible membrane near the sidewalls of the fluid chamber. For these and other reasons, there is a need for the present invention.

SUMMARY

One aspect of the present invention provides a fluid ejection device. The fluid ejection device includes a fluid chamber having a first sidewall and a second sidewall, a flexible membrane extended over the fluid chamber and supported at an end of the first sidewall and an end of the second sidewall, an actuator provided on the flexible membrane, a first gap provided between the flexible membrane and the end of the first sidewall, and a second gap provided between the flexible membrane and the end of the second sidewall, and compliant material provided within the first gap and within the second gap. As such, the actuator is adapted to deflect the flexible membrane relative to the fluid chamber.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
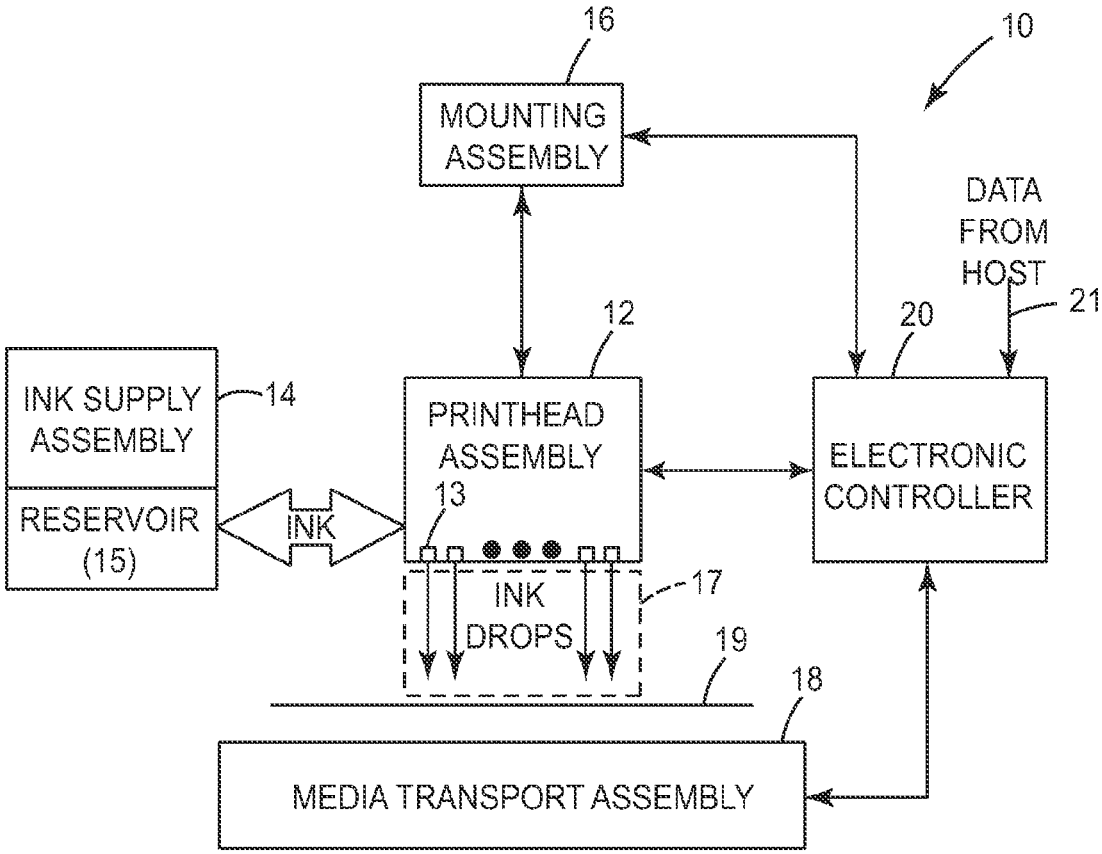
FIG. 1 is a block diagram illustrating one embodiment of an inkjet printing system according to the present invention.

FIG. 1 illustrates one embodiment of an inkjet printing system 10 according to the present invention. Inkjet printing system 10 constitutes one embodiment of a fluid ejection system which includes a fluid ejection device, such as a printhead assembly 12, and a fluid supply, such as an ink supply assembly 14. In the illustrated embodiment, inkjet printing system 10 also includes a mounting assembly 16, a media transport assembly 18, and an electronic controller 20.

Printhead assembly 12, as one embodiment of a fluid ejection device, is formed according to an embodiment of the present invention and ejects drops of ink, including one or more colored inks, through a plurality of orifices or nozzles 13. While the following description refers to the ejection of ink from printhead assembly 12, it is understood that other liquids, fluids, or flowable materials may be ejected from printhead assembly 12.

In one embodiment, the drops are directed toward a medium, such as print medium 19, so as to print onto print medium 19. Typically, nozzles 13 are arranged in one or more columns or arrays such that properly sequenced ejection of ink from nozzles 13 causes, in one embodiment, characters, symbols, and/or other graphics or images to be printed upon print medium 19 as printhead assembly 12 and print medium 19 are moved relative to each other.

Print medium 19 includes, for example, paper, card stock, envelopes, labels, transparent film, cardboard, rigid panels, and the like. In one embodiment, print medium 19 is a continuous form or continuous web print medium 19. As such, print medium 19 may include a continuous roll of unprinted paper.

Ink supply assembly 14, as one embodiment of a fluid supply, supplies ink to printhead assembly 12 and includes a reservoir 15 for storing ink. As such, ink flows from reservoir 15 to printhead assembly 12. In one embodiment, ink supply assembly 14 and printhead assembly 12 form a recirculating ink delivery system. As such, ink flows back to reservoir 15 from printhead assembly 12. In one embodiment, printhead assembly 12 and ink supply assembly 14 are housed together in an inkjet or fluidjet cartridge or pen. In another embodiment, ink supply assembly 14 is separate from printhead assembly 12 and supplies ink to printhead assembly 12 through an interface connection, such as a supply tube (not shown).

Mounting assembly 16 positions printhead assembly 12 relative to media transport assembly 18, and media transport assembly 18 positions print medium 19 relative to printhead assembly 12. As such, a print zone 17 within which printhead assembly 12 deposits ink drops is defined adjacent to nozzles 13 in an area between printhead assembly 12 and print medium 19. Print medium 19 is advanced through print zone 17 during printing by media transport assembly 18.

In one embodiment, printhead assembly 12 is a scanning type printhead assembly, and mounting assembly 16 moves printhead assembly 12 relative to media transport assembly 18 and print medium 19 during printing of a swath on print medium 19. In another embodiment, printhead assembly 12 is a non-scanning type printhead assembly, and mounting assembly 16 fixes printhead assembly 12 at a prescribed position relative to media transport assembly 18 during printing of a swath on print medium 19 as media transport assembly 18 advances print medium 19 past the prescribed position.

Electronic controller 20 communicates with printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops, is determined by the print job commands and/or command parameters. In one embodiment, logic and drive circuitry forming a portion of electronic controller 20 is located on printhead assembly 12. In another embodiment, logic and drive circuitry forming a portion of electronic controller 20 is located off printhead assembly 12.

Figure 2:
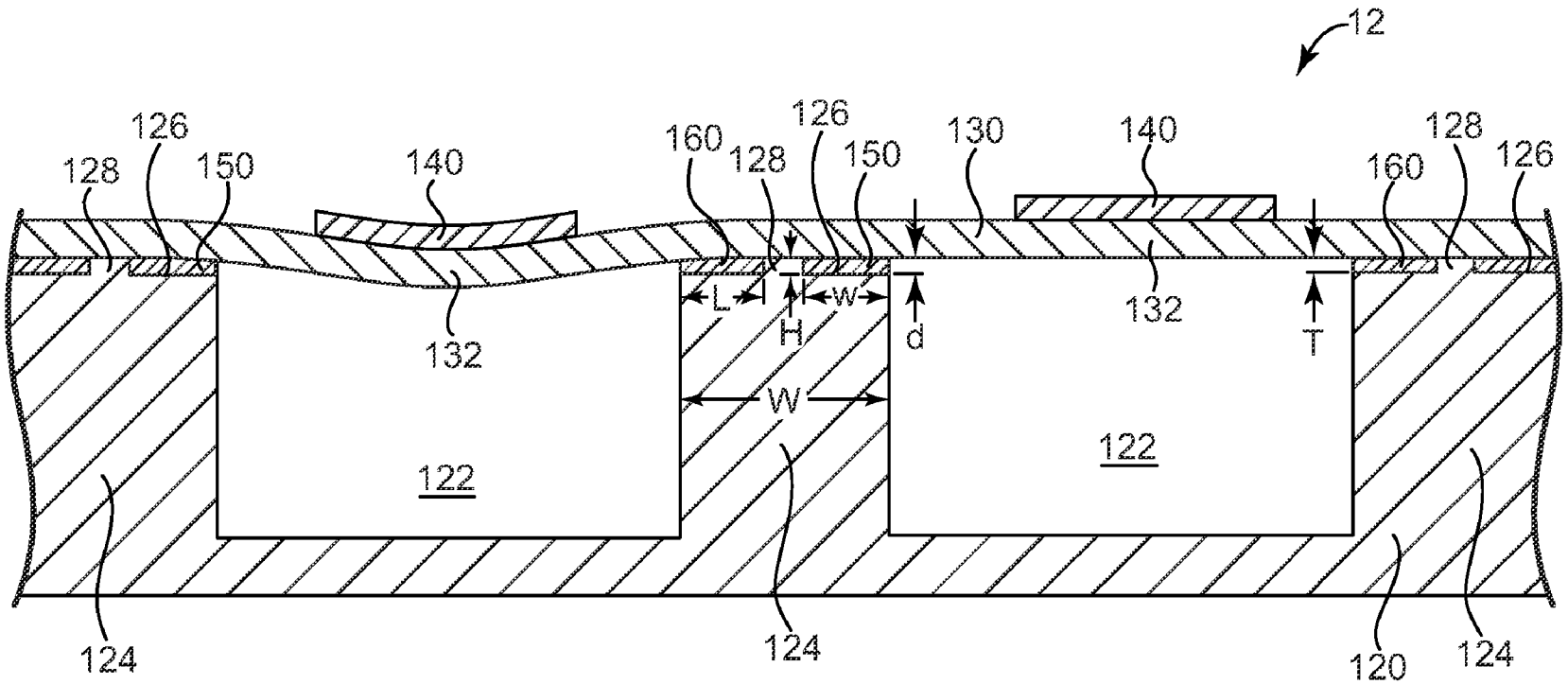
FIG. 2 is a schematic cross-sectional view illustrating one embodiment of a portion of a printhead assembly according to the present invention.

FIG. 2 illustrates one embodiment of a portion of printhead assembly 12. Printhead assembly 12, as one embodiment of a fluid injection device, includes a substrate 120, a flexible membrane 130, and actuators 140. Substrate 120, flexible membrane 130, and actuators 140 are arranged and interact, as described below, to eject drops of fluid from printhead assembly 12.

In one embodiment, substrate 120 has a plurality of fluid chambers 122 defined therein. In one embodiment, fluid chambers 122 are defined by sidewalls 124 of substrate 120. Fluid chambers 122 communicate with a supply of fluid such that fluid within fluid chamber 122 is ejected from fluid chambers 122 through orifices or nozzles 13 (FIG. 1) communicated with fluid chambers 122. In one embodiment, fluid within fluid chambers 122 is ejected in a direction substantially perpendicular to a direction of displacement or deflection of flexible membrane 130 (for example, in a direction into or out of the plane of FIG. 2).

In one embodiment, substrate 120 is a silicon substrate and fluid chambers 122 are formed in substrate 120 using photolithography and etching techniques.

As illustrated in the embodiment of FIG. 2, flexible membrane 130 is supported by substrate 120 and extends over fluid chambers 122. More specifically, in one embodiment, flexible membrane 130 is supported by sidewalls 124 of substrate 120. In one embodiment, flexible membrane 130 is a single membrane extended over an array of or multiple fluid chambers 122. As such, in one embodiment, flexible membrane 130 includes flexible membrane portions 132 each defined over one fluid chamber 122.

In one embodiment, flexible membrane 130 is formed of a flexible material such as, for example, a flexible thin film of silicon nitride or silicon carbide, or a flexible thin layer of silicon. In one exemplary embodiment, flexible membrane 130 is formed of glass. In one embodiment, flexible membrane 130 is attached to substrate 120 by anodic bonding or similar techniques.

As illustrated in the embodiment to FIG. 2, actuators 140 are provided on flexible membrane 130. More specifically, each actuator 140 is provided on a respective flexible membrane portion 132. In one embodiment, as described below, actuators 140 deflect flexible membrane portions 132 such that when flexible membrane portions 132 of flexible membrane 130 deflect, droplets of fluid are ejected from a respective orifice or nozzle 13 (FIG. 1) of printhead assembly 12.

In one embodiment, actuators 140 are provided or formed on a side of flexible membrane 130 opposite fluid chambers 122. As such, actuators 140 are not in direct contact with fluid contained within fluid chambers 122. Thus, potential affects of fluid contacting actuators 140, such as corrosion or electrical shorting, are reduced.

In one embodiment, actuators 140 include a piezoelectric material which changes shape, for example, expands and/or contracts, in response to an electrical signal. Thus, in response to the electrical signal, actuators 140 apply a force to respective flexible membrane portions 132 which cause flexible membrane portions 132 to deflect. Examples of a piezoelectric material include zinc oxide or a piezoceramic material such as barium titanate, lead zirconium titanate (PZT), or lead lanthanum zirconium titanate (PLZT). It is understood that actuators 140 may include any type of device which causes movement or deflection of flexible membrane portions 132 including, for example, an electrostatic, magnetostatic, and/or thermal expansion actuator.

In one embodiment, actuators 140 are formed from a single or common piezoelectric material. More specifically, the single or common piezoelectric material is provided on flexible membrane 130, and selective portions of the piezoelectric material are removed such that the remaining portions of the piezoelectric material define actuators 140.

As illustrated in the embodiment of FIG. 2, flexible membrane 130 is supported at ends 126 of sidewalls 124. In one embodiment, flexible membrane 130 is supported at ends 126 such that gaps 150 are provided between flexible membrane 130 and ends 126 of sidewalls 124. In one embodiment, gaps 150 are formed by posts or supports 128 extended from ends 126 of sidewalls 124. As such, flexible membrane 130 is supported at ends 126 of sidewalls 124 by supports 128.

Although a single post or support 128 is illustrated as extending from a respective end 126 of each sidewall 124, it is within the scope of the present invention for one or more posts or supports 128 to extend from a respective end 126 of each sidewall 124. In addition, although posts or supports 128 are illustrated as extending from a center of sidewalls 124, it is within the scope of the present invention for posts or supports 128 to be offset from a center of a respective sidewall 124.

In one embodiment, sidewalls 124 have a width W and supports 128 have a height H. In addition, gaps 150 have a width w and a depth d. In one embodiment, width w of gaps 150 is less than width W of sidewalls 124, and depth d of gaps 150 is equal to or corresponds to height H of supports 128. In one embodiment, height H of supports 128 and, therefore, depth d of gaps 150 is less than 100× a maximum distance of displacement or deflection of flexible membrane 130. In one exemplary embodiment, for example, a maximum distance of displacement or deflection of flexible membrane 130 is approximately 0.1 microns. Thus, in one exemplary embodiment, height H of supports 128 and, therefore, depth d of gaps 150 is less than approximately 10 microns.

By supporting flexible membrane 130 by supports 128 and providing gaps 150 between flexible membrane 130 and ends 126 of sidewalls 124, a supported width of flexible membrane 130, referred to herein as the effective width ($W_{EFF}$) of flexible membrane 130, is increased relative to a width ($W_{FC}$) of fluid chambers 122 as defined between sidewalls 124. For example, the effective width of flexible membrane 130 is increased by 2× width w of gaps 150. By increasing the effective width of flexible membrane 130, displacement of flexible membrane 130 may also be increased. As such, a desired displacement of flexible membrane 130 may be achieved with a reduced or narrower distance between sidewalls 124. Accordingly, fluid chambers 122, and their associated orifices or nozzles, may be positioned closer together thereby enabling higher orifice or nozzle density. In addition, width W of sidewalls 124 may be maintained thereby minimizing or avoiding mechanical cross-talk between adjacent fluid chambers 122.

In one embodiment, as illustrated in FIG. 2, compliant material 160 is provided within gaps 150. As such, compliant material 160 seals gaps 150 while still allowing flexible membrane 130 to move or deflect. By sealing gaps 150, compliant material 160 prevents bubbles or particles in fluid within fluid chambers 122 from being trapped in gaps 150. In addition, compliant material 160 may act as a dampener to quell high frequency modes of flexible membrane 130. In one exemplary embodiment, compliant material 160 is a polymer material such as parylene, ORDYL® or SU8®.

As illustrated in the embodiment of FIG. 2, compliant material 160 has a thickness T and a length L. In one embodiment, thickness T of compliant material 160 is substantially equal to or substantially corresponds to height H of supports 128. As depth d of gaps 150 corresponds to height H of supports 128, compliant material 160 substantially fills and seals depth d of gaps 150. In one embodiment, length L of compliant material 160 is substantially equal to or substantially corresponds to width w of gaps 150. As such, compliant material 160 substantially fills and seals width w of gaps 150.

In one exemplary embodiment, compliant material 160 is formed by a polymer coating, such as parylene, vapor deposited to fill gaps 150. In one exemplary embodiment, with a width of fluid chambers 122 being approximately 410 microns, width W of sidewalls 124 being approximately 100 microns, a thickness of flexible membrane 130 being approximately 50 microns, and a thickness of actuators 140 being approximately 45 microns, thickness T of compliant material 160 is in a range of approximately 5 microns to approximately 10 microns, and length L of compliant material 160 is approximately 37 microns.

Figure 3:
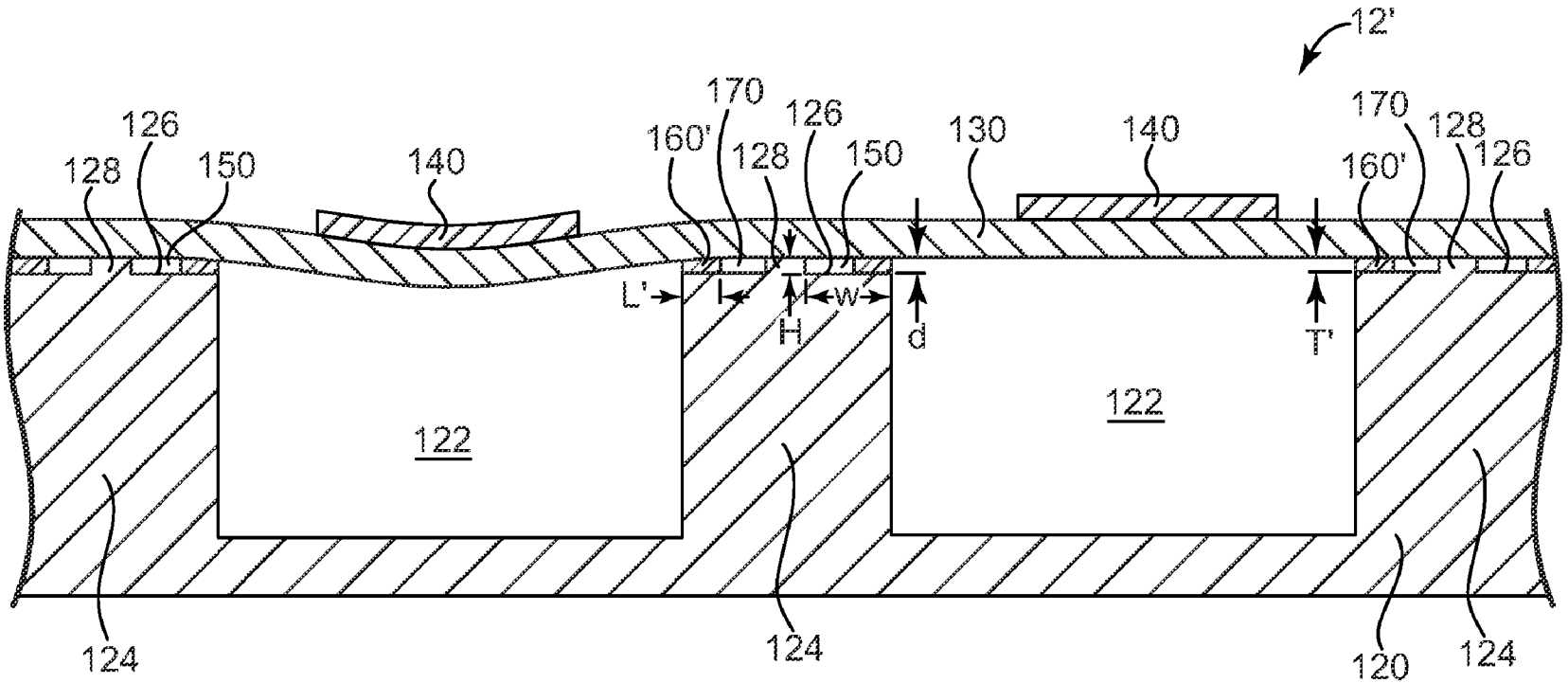
FIG. 3 is a schematic cross-sectional view illustrating another embodiment of a portion of a printhead assembly according to the present invention.

FIG. 3 illustrates another embodiment of printhead assembly 12. In the embodiment of FIG. 3, printhead assembly 12' includes substrate 120, flexible membrane 130, and actuators 140. In addition, printhead assembly 12' includes gaps 150 provided between flexible membranes 130 and ends 126 of sidewalls 124. As illustrated and described above with reference to FIG. 2, gaps 150 are formed by posts or supports 128 extending from ends 126 of sidewalls 124.

As illustrated in the embodiment of FIG. 3, printhead assembly 12' includes compliant material 160' provided within gaps 150. Similar to compliant material 160, compliant material 160' has a thickness T' substantially equal to or substantially corresponding to height H of supports 128 such that compliant material 160' substantially fills and seals depth d of gaps 150. A length L' of compliant material 160', however, is less than width w of gaps 150. As such, cavities 170 are formed between supports 128 and compliant material 160' within gaps 150. Compliant material 160', however, similar to compliant material 160, seals gaps 150 thereby preventing bubbles or particles in fluid within fluid chambers 122 from being trapped in gaps 150 while still allowing flexible membrane 130 to move or deflect.

Figure 4:
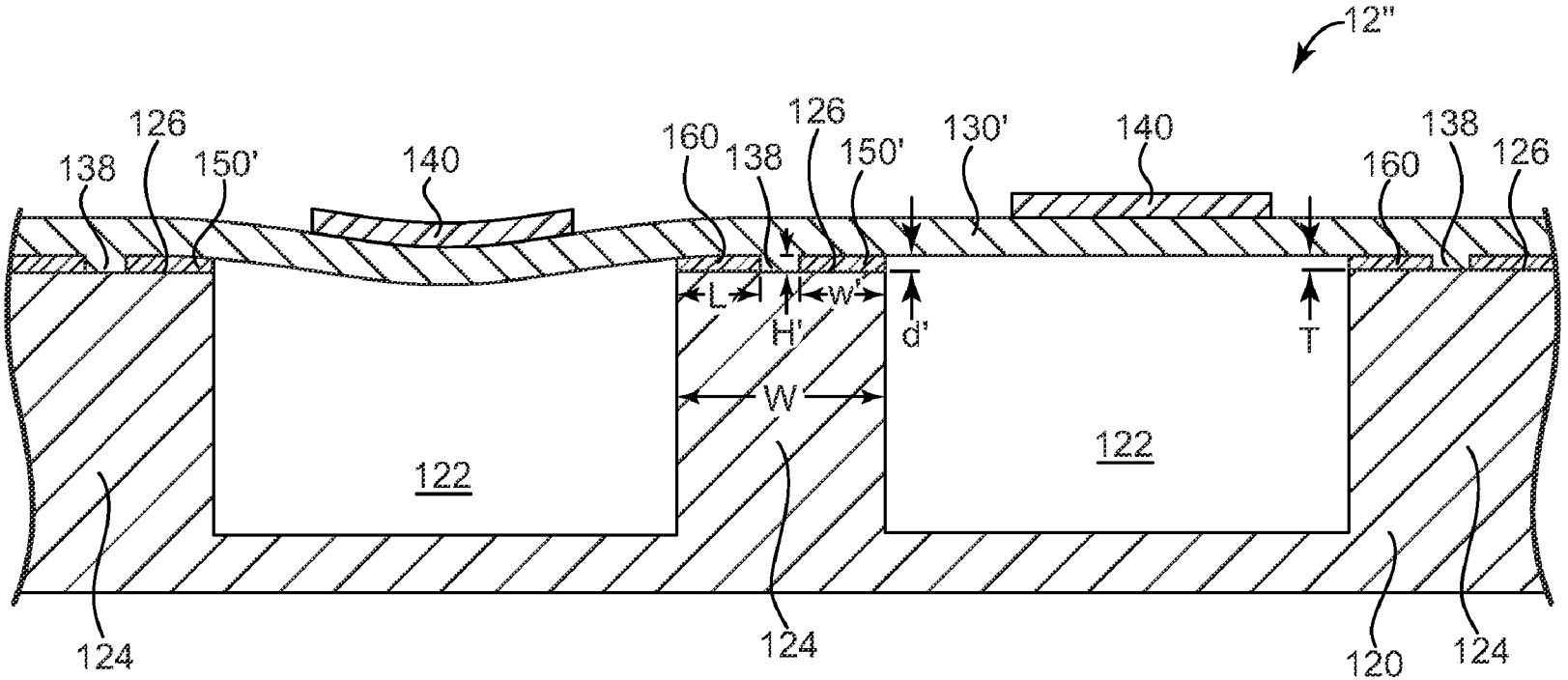
FIG. 4 is a schematic cross-sectional view illustrating another embodiment of a portion of a printhead assembly according to the present invention.

FIG. 4 illustrates another embodiment of printhead assembly 12. In the embodiment of FIG. 4, printhead assembly 12" includes substrate 120, flexible membrane 130', and actuators 140. Flexible membrane 130' is supported at ends 126 of sidewalls 124 such that gaps 150' are provided between flexible membrane 130' and ends 126 of sidewalls 124. In one embodiment, similar to that illustrated and described above with reference to FIG. 2, compliant material 160 is provided within gaps 150'. Thus, similar to compliant material 160 provided within gaps 150, compliant material 160 seals gaps 150' while still allowing flexible membrane 130' to move or deflect.

As illustrated in the embodiment of FIG. 4, gaps 150' are formed by posts or supports 138 extended from flexible membrane 130'. As such, flexible membrane 130' is supported at ends 126 of sidewalls 124 by supports 138. Although a single post or support 138 is illustrated as extending from flexible membrane 130' at each sidewall 124, it is within the scope of the present invention for one or more posts or supports 138 to extend from flexible membrane 130' at each sidewall 124. In addition, although posts or supports 138 are illustrated as being aligned with a center of a respective sidewall 124, it is within the scope of the present invention for posts or supports 138 to be offset from a center of a respective sidewall 124.

In one embodiment, supports 138 have a height H' and, similar to that illustrated and described above with reference to FIG. 2, gaps 150' have a width w' and a depth d'. In one embodiment, width w' of gaps 150' is less than width W of sidewalls 24, and depth d' of gaps 150' is equal to or corresponds to height H' of supports 138. In one embodiment, thickness T of compliant material 160 is substantially equal to or substantially corresponds to height H' of supports 138 such that compliant material 160 substantially fills and seals depth d' of gaps 150'. In addition, length L of compliant material 160 is substantially equal to or substantially corresponds to width w' of gaps 150' such that compliant material 160 substantially fills and seals width w' of gaps 150'.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A fluid ejection device, comprising:

a fluid chamber having a first sidewall and a second sidewall;

a flexible membrane extended over the fluid chamber and supported at an end of the first sidewall and an end of the second sidewall;

an actuator provided on the flexible membrane, the actuator adapted to deflect the flexible membrane relative to the fluid chamber;

a first gap provided between the flexible membrane and the end of the first sidewall, and a second gap provided between the flexible membrane and the end of the second sidewall; and compliant material provided within the first gap and within the second gap, and further comprising:

a first support extended from one of the flexible membrane and the end of the first sidewall, and a second support extended from one of the flexible membrane and the end of the second sidewall, wherein the flexible membrane is supported at the end of the first sidewall by the first support and at the end of the second sidewall by the second support, and wherein the first gap is provided between the flexible membrane and the end of the first sidewall adjacent the first support, and the second gap is provided between the flexible membrane and the end of the second sidewall adjacent the second support.

2. The fluid ejection device of claim 1, further comprising:

a first cavity provided between the first support and the compliant material within the first gap, and a second cavity provided between the second support and the compliant material within the second gap.

3. A fluid ejection device, comprising:

a fluid chamber having a first sidewall and a second sidewall;

a flexible membrane extended over the fluid chamber and supported at an end of the first sidewall and an end of the second sidewall;

an actuator provided on the flexible membrane, the actuator adapted to deflect the flexible membrane relative to the fluid chamber;

a first gap provided between the flexible membrane and the end of the first sidewall, and a second gap provided between the flexible membrane and the end of the second sidewall; and compliant material provided within the first gap and within the second gap, wherein the first sidewall and the second sidewall each have a width, and wherein the first gap and the second gap each have a width less than the width of the first sidewall and the second sidewall, respectively.

4. The fluid ejection device of claim 3, wherein a width of the compliant material within the first gap and within the second gap is substantially equal to the width of the first gap and the second gap, respectively.

5. The fluid ejection device of claim 3, wherein a width of the compliant material within the first gap and within the second gap is less than the width of the first gap and the second gap, respectively.

6. The fluid ejection device of claim 3, wherein the first gap and the second gap each have a depth, and wherein a thickness of the compliant material within the first gap and within the second gap is substantially equal to the depth of the first gap and the second gap, respectively.

7. The fluid ejection device of claim 3, wherein a width of displacement of the flexible membrane is greater than a width of the fluid chamber.

8. The fluid ejection device of claim 3, wherein the fluid chamber includes an array of fluid chambers having respective first sidewalls and respective second sidewalls, wherein the flexible membrane includes flexible membrane portions each extended over one of the fluid chambers and supported at an end of the respective first sidewalls and an end of the respective second sidewalls, wherein the actuator includes a plurality of actuators each provided on a respective flexible membrane portion, wherein respective first gaps are provided between the respective flexible membrane portions and the end of the respective first sidewalls, and respective second gaps are provided between the respective flexible membrane portions and the end of the respective second sidewalls, and wherein the compliant material is provided within the respective first gaps and within the respective second gaps.

9. The fluid ejection device of claim 3, further comprising:

a first cavity provided between the first support and the compliant material within the first gap, and a second cavity provided between the second support and the compliant material within the second gap.

10. A fluid ejection device, comprising:

a fluid chamber having a first sidewall and a second sidewall;

means for supporting a flexible membrane extended over the fluid chamber by the first sidewall and the second sidewall, and providing a first gap between the flexible membrane and an end of the first sidewall and a second gap between the flexible membrane and an end of the second sidewall;

means for deflecting the flexible membrane relative to the fluid chamber; and compliant material provided within the first gap and within the second gap, wherein the means for supporting the flexible membrane and providing the first gap and the second gap includes a first support extended from one of the flexible membrane and the end of the first sidewall, and a second support extended from one of the flexible membrane and the end of the second sidewall, wherein the first gap is provided between the flexible membrane and the end of the first sidewall adjacent the first support, and the second gap is provided between the flexible membrane and the end of the second sidewall adjacent the second support.

11. The fluid ejection device of claim 10, further comprising:

means for providing a first cavity between the means for supporting the flexible membrane and the compliant material within the first gap, and a second cavity between the means for supporting the flexible membrane and the compliant material within the second gap.

12. A fluid ejection device, comprising:

a fluid chamber having a first sidewall and a second sidewall;

means for supporting a flexible membrane extended over the fluid chamber by the first sidewall and the second sidewall, and providing a first gap between the flexible membrane and an end of the first sidewall and a second gap between the flexible membrane and an end of the second sidewall;

means for deflecting the flexible membrane relative to the fluid chamber; and compliant material provided within the first gap and within the second gap, wherein the first sidewall and the second sidewall each have a width, and wherein the first gap and the second gap each have a width less than the width of the first sidewall and the second sidewall, respectively.

13. The fluid ejection device of claim 12, wherein a width of the compliant material within the first gap and within the second gap is substantially equal to the width of the first gap and the second gap, respectively.

14. The fluid ejection device of claim 12, wherein a width of the compliant material within the first gap and within the second gap is less than the width of the first gap and the second gap, respectively.

15. The fluid ejection device of claim 12, wherein the first gap and the second gap each have a depth, and wherein a thickness of the compliant material within the first gap and within the second gap is substantially equal to the depth of the first gap and the second gap, respectively.

16. The fluid ejection device of claim 12, further comprising:

means for providing a first cavity between the means for supporting the flexible membrane and the compliant material within the first gap, and a second cavity between the means for supporting the flexible membrane and the compliant material within the second gap.

17. A method of forming a fluid ejection device, comprising:

forming a fluid chamber with a first sidewall and a second sidewall;

extending a flexible membrane over the fluid chamber and supporting the flexible membrane at an end of the first sidewall and an end of the second sidewall, including providing a first gap between the flexible membrane and the end of the first sidewall, and providing a second gap between the flexible membrane and the end of the second sidewall;

providing an actuator on the flexible membrane, wherein the actuator is adapted to deflect the flexible membrane relative to the fluid chamber; and providing compliant material within the first gap and within the second gap, and further comprising:

extending a first support from one of the flexible membrane and the end of the first sidewall, and extending a second support from one of the flexible membrane and the end of the second sidewall, wherein supporting the flexible membrane includes supporting the flexible membrane at the end of the first sidewall by the first support, and supporting the flexible membrane at the end of the second sidewall by the second support, and wherein providing the first gap and providing the second gap includes providing the first gap between the flexible membrane and the end of the first sidewall adjacent the first support, and providing the second gap between the flexible membrane and the end of the second sidewall adjacent the second support.

18. The method of claim 17, further comprising:

providing a first cavity between the first support and the compliant material within the first gap, and providing a second cavity between the second support and the compliant material within the second gap.

19. A method of forming a fluid ejection device, comprising:

forming a fluid chamber with a first sidewall and a second sidewall;

extending a flexible membrane over the fluid chamber and supporting the flexible membrane at an end of the first sidewall and an end of the second sidewall, including providing a first gap between the flexible membrane and the end of the first sidewall, and providing a second gap between the flexible membrane and the end of the second sidewall;

providing an actuator on the flexible membrane, wherein the actuator is adapted to deflect the flexible membrane relative to the fluid chamber; and providing compliant material within the first gap and within the second gap, wherein the first sidewall and the second sidewall each have a width, and wherein providing the first gap and providing the second gap includes providing the first gap and the second gap each with a width less than the width of the first sidewall and the second sidewall, respectively.

20. The method of claim 19, wherein providing the compliant material within the first gap and within the second gap includes providing the compliant material with a width substantially equal to the width of the first gap and the second gap, respectively.

21. The method of claim 19, wherein providing the compliant material within the first gap and within the second gap includes providing the compliant material with a width less than the width of the first gap and the second gap, respectively.

22. The method of claim 19, wherein providing the compliant material within the first gap and within the second gap includes providing the compliant material with a thickness substantially equal to a depth of the first gap and the second gap, respectively.

23. The method of claim 19, further comprising:

providing a first cavity between the first support and the compliant material within the first gap, and providing a second cavity between the second support and the compliant material within the second gap.

* * * * *